US006279637B2

(12) United States Patent
Lenhof et al.

(10) Patent No.: US 6,279,637 B2
(45) Date of Patent: Aug. 28, 2001

(54) APPARATUS FOR AUTOMATICALLY INSTALLING A GRIP ON A GOLF CLUB SHAFT

(75) Inventors: Konrad Lenhof, Vista; Jerry V. Blanke, Murrieta, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/753,270

(22) Filed: Dec. 29, 2000

Related U.S. Application Data

(62) Division of application No. 09/357,694, filed on Jul. 20, 1999.

(51) Int. Cl.[7] ..... B29C 1/00

(52) U.S. Cl. ..... 156/423; 156/447; 156/446; 156/475; 156/494; 156/556; 29/450; 473/300

(58) Field of Search ..... 156/187, 195, 156/191, 293, 294, 428, 423, 285, 176, 86, 450, 447, 446, 475, 794, 556; 29/458, 460, 514, 33.5, 33 Q, 450, 429; 427/385.5, 389.9, 393.4; 473/300

(56) References Cited

U.S. PATENT DOCUMENTS

| | | | | |
|---|---|---|---|---|
| 4,125,423 | * | 11/1978 | Goldsworthy | 156/428 |
| 4,899,428 | * | 2/1990 | Hsu | 29/234 |
| 5,281,288 | * | 1/1994 | Murray et al. | 156/83 |
| 5,407,026 | * | 4/1995 | Vald'via | 184/74 |
| 5,429,706 | * | 7/1995 | Cresse et al. | 156/346 |
| 5,870,815 | * | 2/1999 | Karner et al. | 29/407 |

* cited by examiner

*Primary Examiner*—Jeanette Chapman
*Assistant Examiner*—Sneh Varma
(74) *Attorney, Agent, or Firm*—Michael A. Catania

(57) ABSTRACT

An automated apparatus for installation of a handgrip on a golf club shaft is disclosed herein. The handgrip is installed on the golf club shaft in a dry state. The present invention does not utilize solvents, lubricants or the like for the installation of the handgrip onto the golf club shaft. The apparatus has a taping mechanism for automatically wrapping a double-sided tape onto the butt end of the golf club shaft. The apparatus also has a gripping mechanism for preparing a grip for automated installation on a shaft while in a dry state. The apparatus also has a shaft shuttle mechanism for transferring the golf club shaft from the taping mechanism to the gripping mechanism. The gripping mechanism has means for expanding the handgrip prior to placement on the butt end of the golf club shaft.

10 Claims, 15 Drawing Sheets

APPARATUS FOR AUTOMATICALLY INSTALLING A GRIP ON A GOLF CLUB SHAFT

CROSS REFERENCES TO RELATED APPLICATIONS

The present application is a divisional application of co-pending U.S. patent application Ser. No. 09/357,694, which was filed on Jul. 20, 1999.

STATEMENT REGARDING FEDERALLY SPONSORED RESEARCH OR DEVELOPMENT

Not Applicable

BACKGROUND OF THE INVENTION

1. Field of the Invention

The present invention relates to insallation of a grip on a golf club shaft. More specifically, the present invention relates to a method and apparatus for automatically placing a handgrip on a golf club shaft without the use of a solvent.

2. Description of the Related Art

Grips have been used on golf clubs to provide a golfer with a greater ability to grasp the golf club during a swing. Grips were used as early as the 1700s when sheepskin grips were the choice of golfers. In the 1800s, leather grips began to appear on a golf clubs, and soon became the dominant grip. In the 1900s, numerous rubber grips were developed mainly by rubber manufacturers. Presently, grips are composed of synthetic rubbers, plastics, and the like.

Handgrips are usually placed on the butt end of a golf club shaft at the club manufacturer. This process has for the most part been a manual process, with very little automation. A golf club shaft is manually wrapped with a double-sided tape at its butt end. Next, a solvent or lubricant is sprayed into the hollow interior of the handgrip, through an open end, in order to place the handgrip over the wrapped butt end without deterring from the adhesiveness of the tape. The handgrip is pulled over the shaft until the closed end of the handgrip is flush with the butt end of the shaft. The solvent eventually evaporates allowing for the tape to adhere to the surface of the hollow interior of the handgrip. Thus, it is obvious that this is a highly repetitious process may lead to injuries to some laborers unless remedial steps are taken by the manufacturer. Further, the use of certain solvents and lubricants may be an environmentally unfriendly means of manufacturing. Yet further, the spraying of a solvent or lubricant is an undesirable step which increases the production time.

The golf industry, and those associated with it, have attempted to automate some of the processes to increase production and lessen injury to laborers. One example is Hsu, U.S. Pat. No. 4,899,428 ("the '428 Patent") for a Golf Club Handle Sleeve Assembling Mechanism. The '428 Patent discloses an assembling mechanism that includes slidable tables, triple acutators with hooks for expanding the front end of the handgrip, an air blower for blowing air into the rear of the handgrip and a fluid hose for delivering a solvent or lubricant to the handgrip for facilitating insertion of the shaft into the handgrip. Another example is Vald'via, U.S. Pat. No. 5,407,026 ("the '026 Patent") for a Golf Club Grip Installing Apparatus. The '026 Patent discloses the use of a grip lubricating device and a golf club shaft lubricating device. The '026 Patent allows for a controlled amount of lubricant to be applied for facilitated insertion of the shaft into the grip. Another example is Cresse et al., U.S. Pat. No. 5,429,706 ("the '706 Patent") for a System And Method For Installing A Hollow Handgrip Over An Elongated Shaft End. The '706 discloses a system and method for applying a liquid adhesive to an interior surface of the handgrip in substitution for the use of tape on the shaft to adhere the grip. The '706 patent inflates the handgrip prior to insertion of the shaft into the grip. Another example is U.S. Pat. No. 5,870,815 ("the '815 Patent") for an Apparatus And Method For Aligning A Golf Club For Attaching A Handle Grip. The '815 Patent discloses an alignment assembly for positioning of a club head attached to a shaft prior to placement of a handgrip on the butt end of the shaft.

The above-mentioned patents fail to provide a fully automated installation of handgrips to golf club shafts, and also still require the need for a solvent or lubricant. Further, the above-mentioned patents require that a club head is attached to the shaft or that shaft is blocked. There still remains a need for a more automated method, one that can grip an open shaft, and one that does not utilize solvents or lubricants.

BRIEF SUMMARY OF THE INVENTION

The present invention fulfills the needs of the golf industry by providing a better automated process and apparatus for installation of a handgrip onto a golf club shaft. The present invention is able to accomplish this while maintaining the handgrip and the butt end of the golf club shaft in a dry state. That is, the present invention does not utilize solvents, lubricants or the like for installation of a handgrip on a golf club shaft.

One aspect of the present invention is a process for automatically installing a handgrip on a golf club shaft. The handgrip has a hollow interior with a first diameter. The process generally includes maintaining a butt end of a golf club shaft and the hollow interior of the handgrip in a dry state throughout the installation process. The next step of the process is flowing a gaseous medium into the handgrip to expand the hollow interior of the handgrip from the first diameter to a second diameter. The next step is mating the butt end of the golf club shaft with the expanded hollow interior of the handgrip.

The process may also include expanding an open end of the handgrip with a plurality of jaws prior to mating the butt end of the golf club shaft with the expanded hollow interior of the handgrip. The process may also include wrapping a double-sided tape over the butt end of the golf club shaft. The wrapping includes adhering a middle region of the tape to the butt end, then adhering a first side region of the tape to the butt end, and then adhering a second side region of the tape to the butt end with an end portion of the second side region of the tape overlapping the first side region. The process may also include orienting the handgrip for placement on the butt end of the shaft prior to flowing the gaseous medium into the handgrip. The step of mating the butt end of the golf club shaft with the hollow interior of the handgrip may include moving the hollow interior of the handgrip over the butt end of the golf club shaft. Alternatively, the step of mating the butt end of the golf club shaft with the hollow interior of the handgrip may include inserting the butt end of the golf club shaft into the hollow interior of the handgrip. The process may also include moving the plurality of jaws forward for release from the open end of the handgrip after mating the butt end of the golf club shaft with the hollow interior of the handgrip. The plurality of jaws may include six jaws for engaging with and expanding the open end of the handgrip.

Another aspect of the present invention is an apparatus for automatically applying a handgrip to a butt end of a golf club shaft. The apparatus includes a frame, a tape mechanism, a handgrip assembly and a shaft movement mechanism. The tape mechanism is mounted to the frame. The handgrip assembly is also mounted to the frame. The handgrip assembly has an air injector disposed on a handgrip receiving sleeve, a plurality of jaws movable from a closed position to an expanded position, and a drive mechanism. The shaft movement mechanism is capable of movement from a position on the frame in-line with the tape mechanism to a position on the frame in-line with the handgrip assembly.

The apparatus may also include a handgrip orientation device disposed on the handgrip assembly. The handgrip orientation device is capable of orienting a handgrip to a predetermined position. The tape mechanism of the apparatus may include a tape dispenser, a tape cutter disposed in proximity to the tape dispenser, a tape roller rotatable about a fixed axis, and a shaft rotation roller disposed in relation to the tape roller. The shaft movement mechanism of the apparatus may include a plurality of shaft guides for retention of a shaft therein during application of a handgrip to the shaft.

The apparatus may include a shaft orientation device mounted on the frame and inline with the handgrip assembly. The shaft orientation device includes a shaft aligner and a second air injector.

Another aspect of the present invention is an apparatus for automatically applying a handgrip to a butt end of a golf club shaft while maintaining the handgrip and the butt end of the golf club shaft in a dry state. The apparatus includes a frame, means for automatically applying a double-sided tape to the golf club shaft, means for receiving and orienting a handgrip, means for expanding a handgrip for placement on the butt end of a golf club shaft while in a dry state, and means for moving a shaft from a position on the frame in-line with the tape means to a position on the frame in-line with the expanding means. The tape application means is mounted to the frame, and the receiving and orienting means is mounted on the frame.

The apparatus may also include means for receiving a shaft on the apparatus. The apparatus may also include means for orienting a shaft placed in the shaft moving means. The apparatus may also include means for moving a handgrip over a shaft disposed on the shaft moving means.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

There is illustrated in FIG. 1 a top plan view of the automatic grip installation apparatus of the present invention.

There is illustrated in FIG. 2 an isolated view of a golf club handgrip that may be utilized in conjunction with the present invention.

Figure 3:
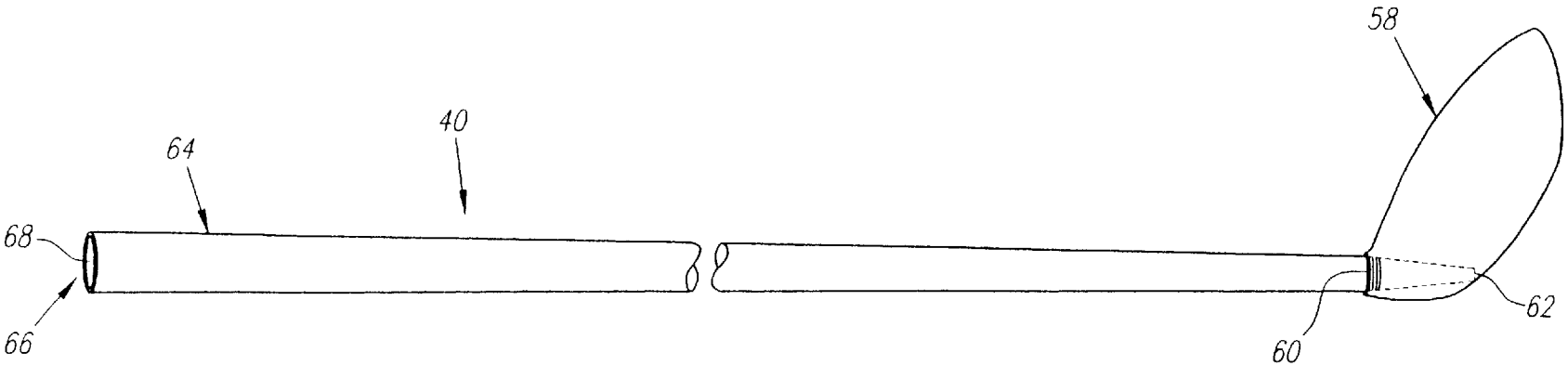

There is illustrated in FIG. 3 an isolated view of an ungripped golf club shaft with a head thereon that may be utilized in conjunction with the present invention.

Figure 4:
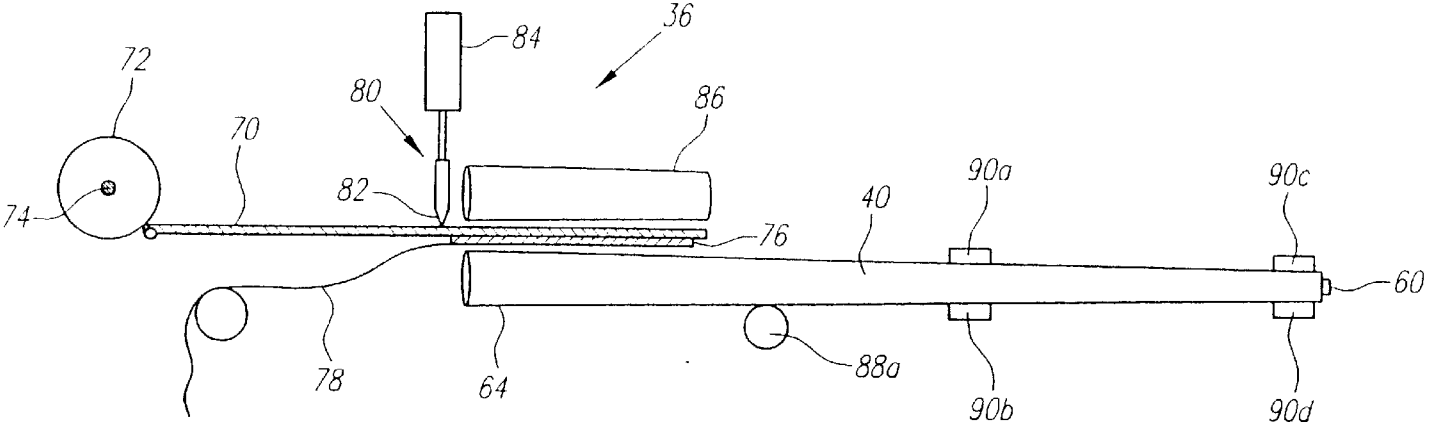

There is illustrated in FIG. 4 is an isolated side view of an ungripped golf club shaft engaged within the tape mechanism of the apparatus of the present invention at a first point in time.

Figure 5:
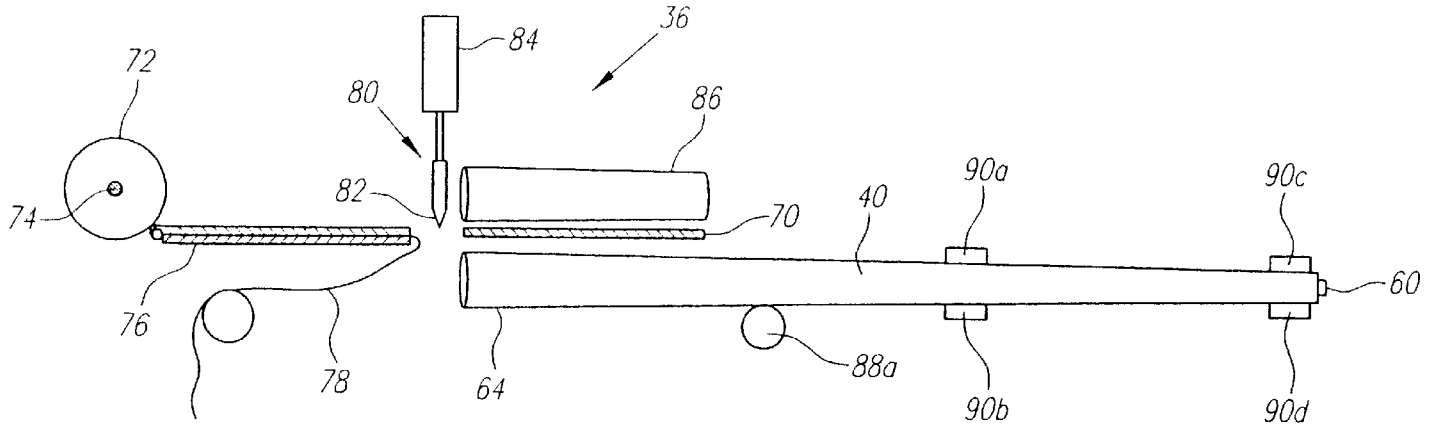

There is illustrated in FIG. 5 is an isolated side view of an ungripped golf club shaft engaged within the tape mechanism of the apparatus of the present invention at a second point in time.

Figure 6:
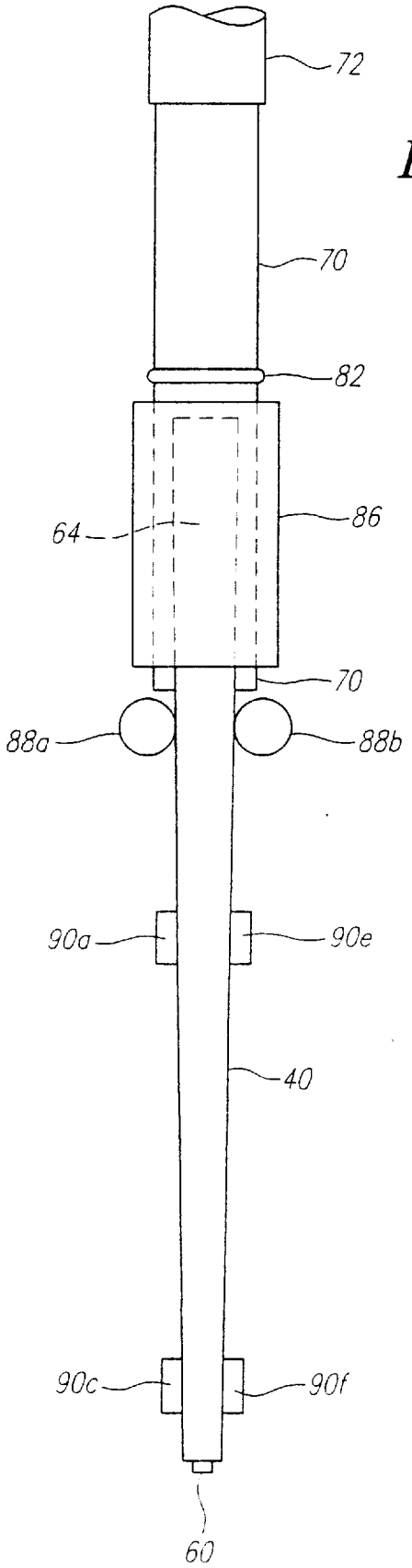

There is illustrated in FIG. 6 is an isolated top plan view of an ungripped golf club shaft engaged within the tape mechanism of the apparatus of the present invention at an initial adhesion of the tape to the shaft.

Figure 6A:
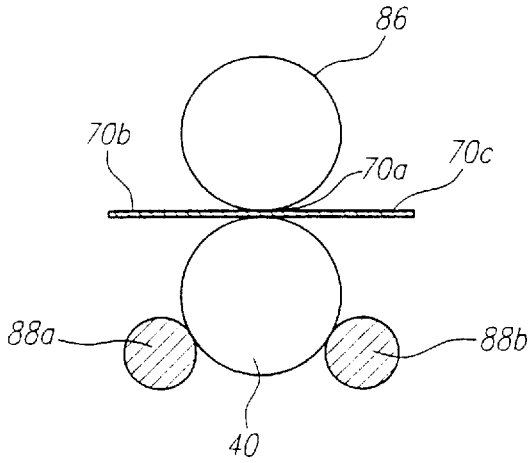

There is illustrated in FIG. 6A a front cross-sectional plan view of FIG. 6.

Figure 7:
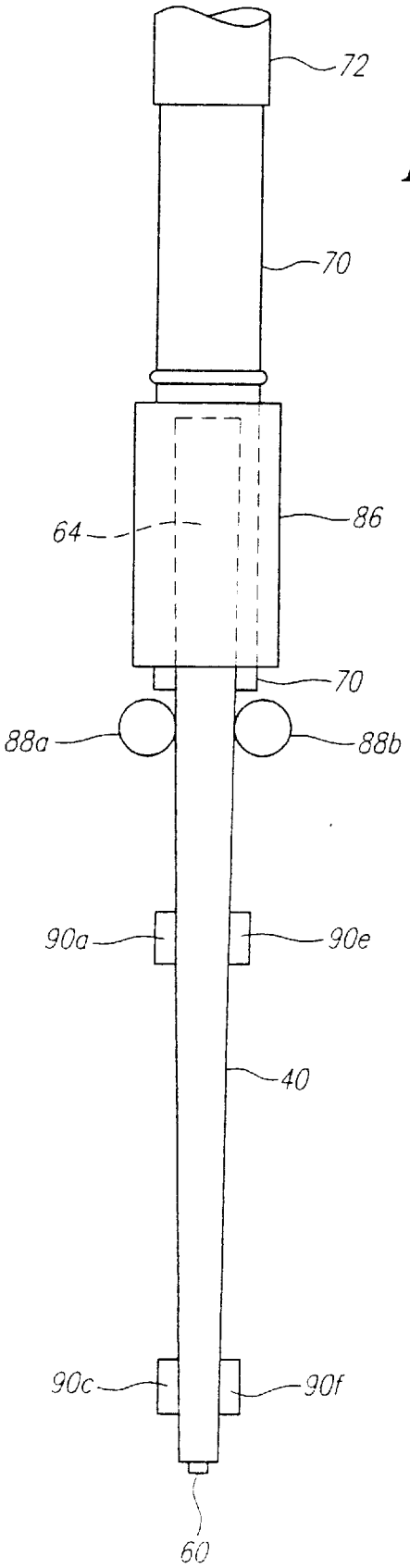

There is illustrated in FIG. 7 is an isolated top plan view of an ungripped golf club shaft engaged within the tape mechanism of the apparatus of the present invention at a later adhesion of the tape to the shaft.

Figure 7A:
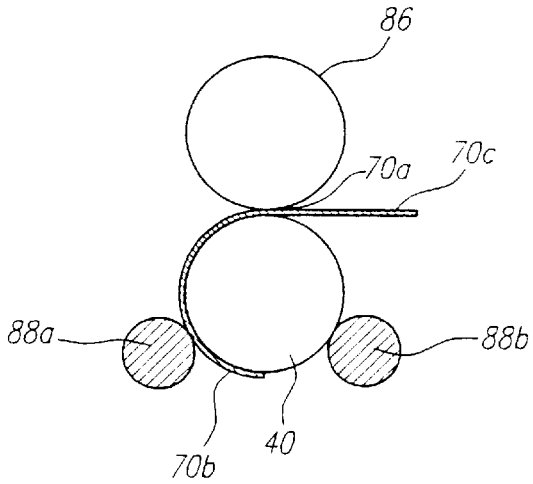

There is illustrated in FIG. 7A a front cross-sectional plan view of FIG. 7.

Figure 8:
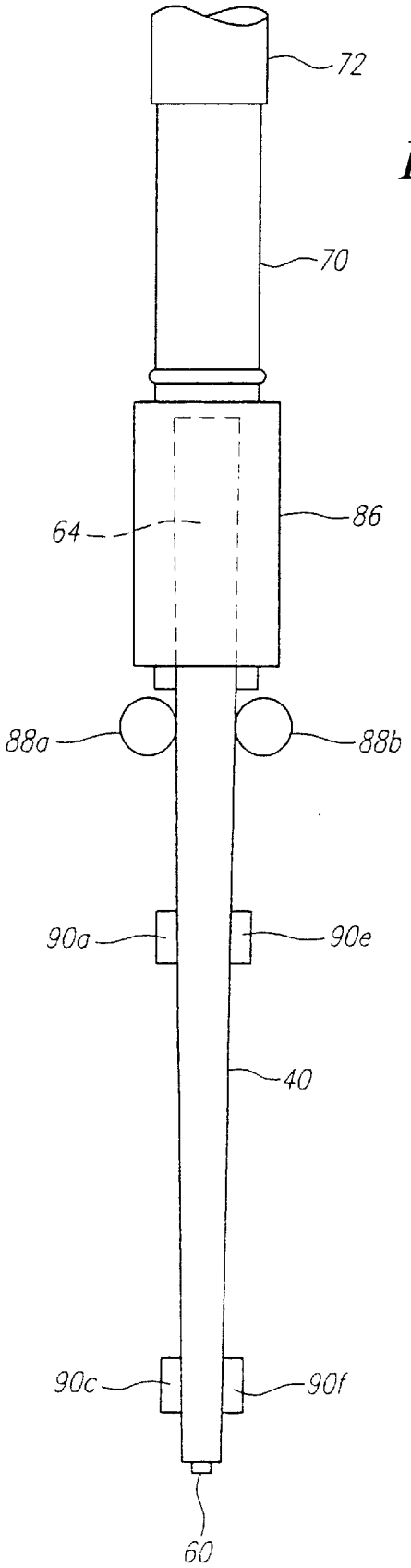

There is illustrated in FIG. 8 is an isolated top plan view of an ungripped golf club shaft engaged within the tape mechanism of the apparatus of the present invention at a final adhesion of the tape to the shaft.

Figure 8A:
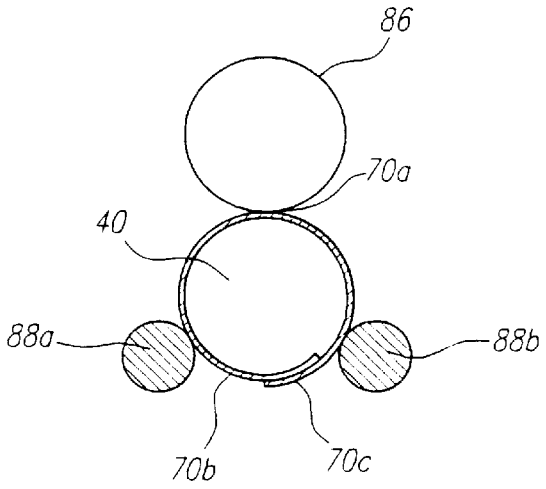

There is illustrated in FIG. 8A a front cross-sectional plan view of FIG. 8.

Figure 9:
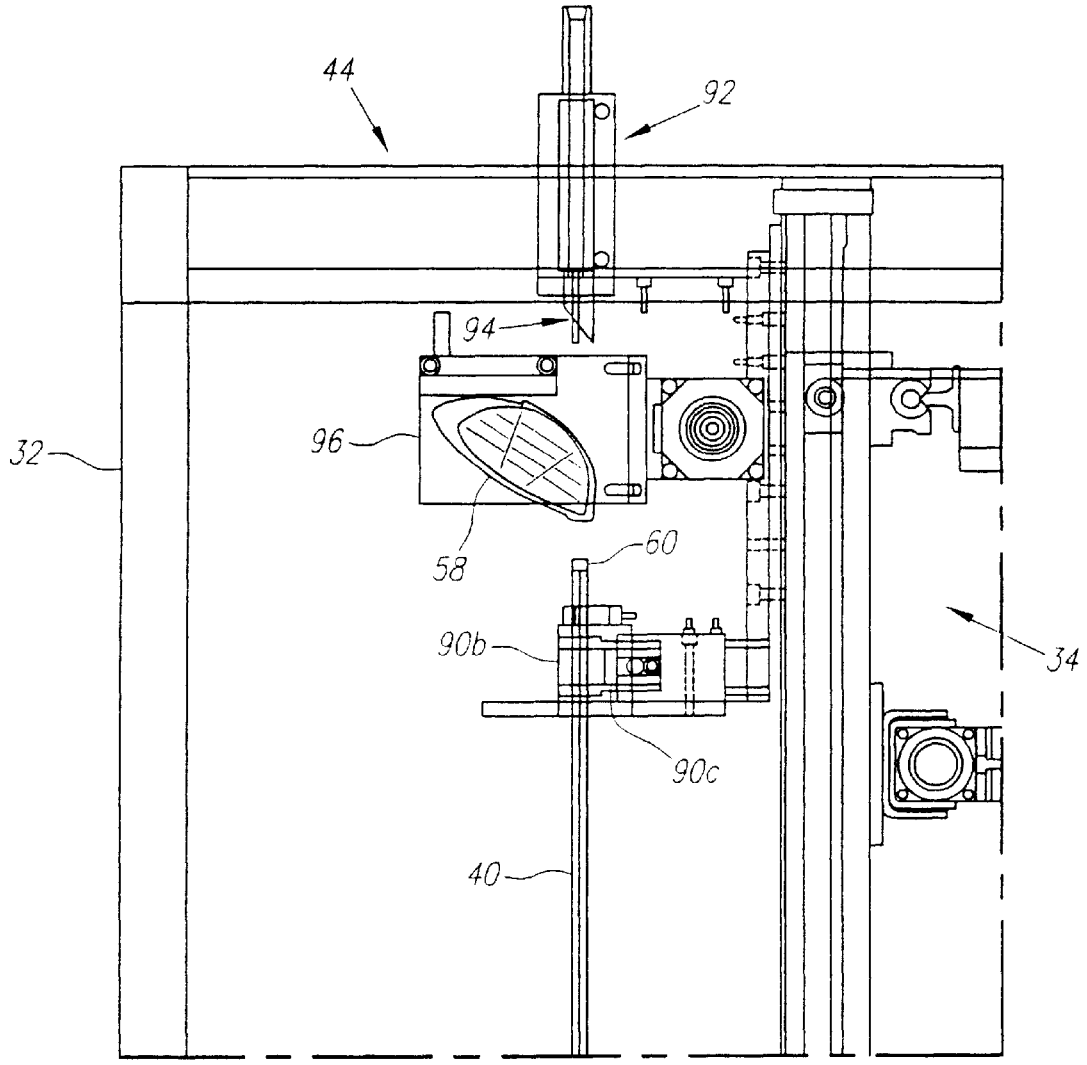

There is illustrated in FIG. 9 an isolated top plan view of the shaft orientation mechanism of the apparatus of the present invention.

Figure 10:
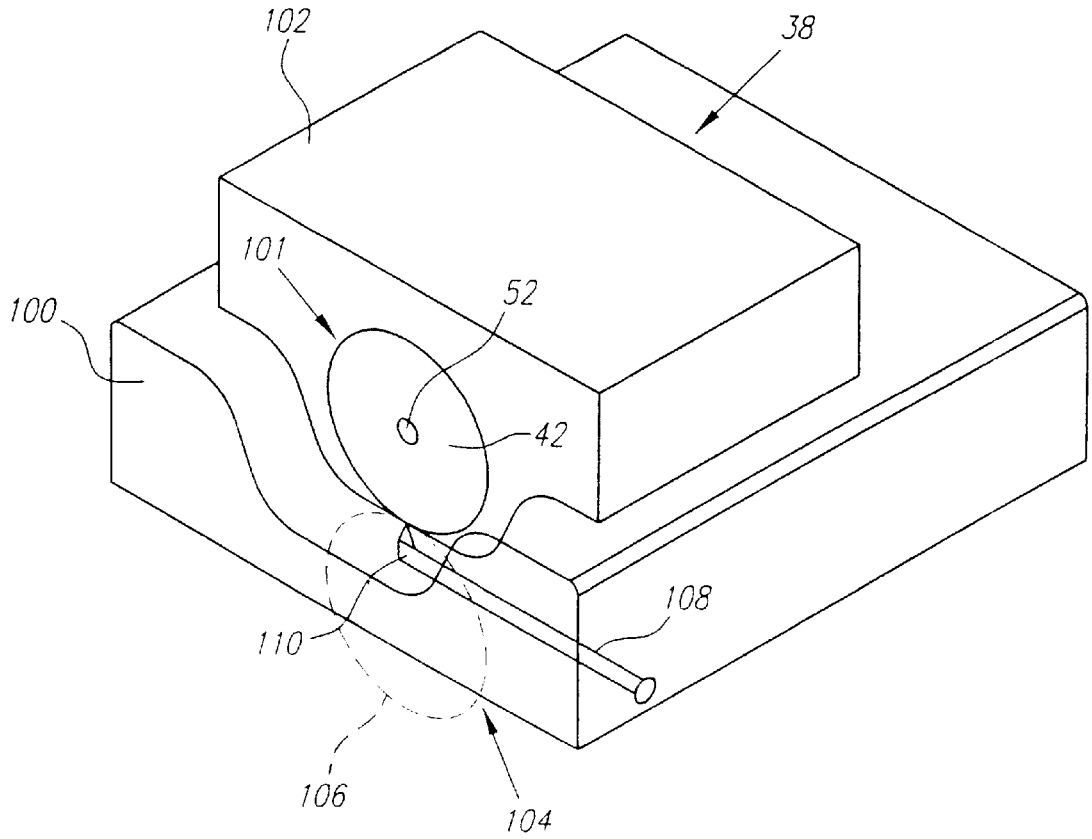

There is illustrated in FIG. 10 an isolated rear view of the grip mechanism of the apparatus of the present invention.

Figure 11:
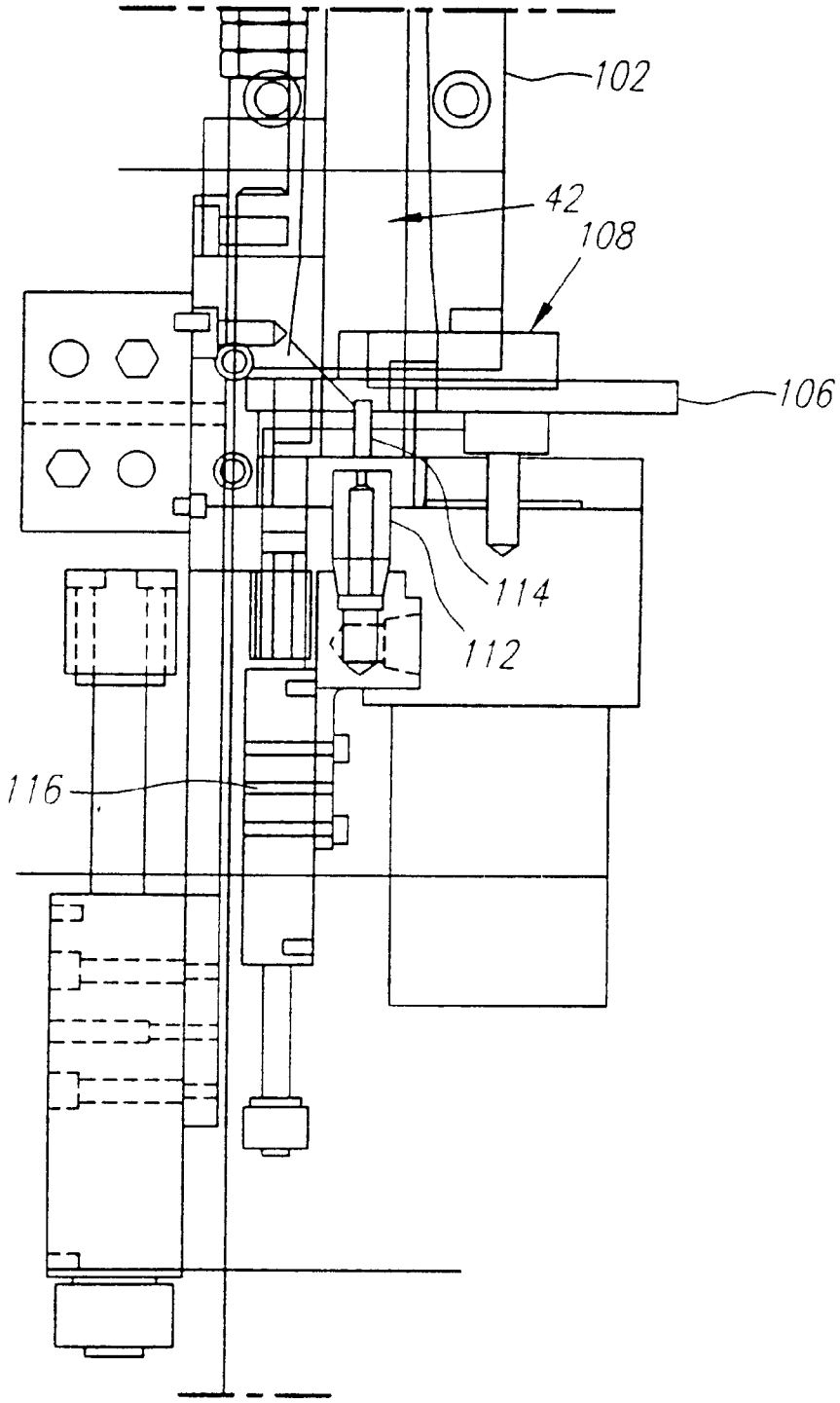

There is illustrated in FIG. 11 a top plan view of the grip mechanism of the apparatus of the present invention.

Figure 12:
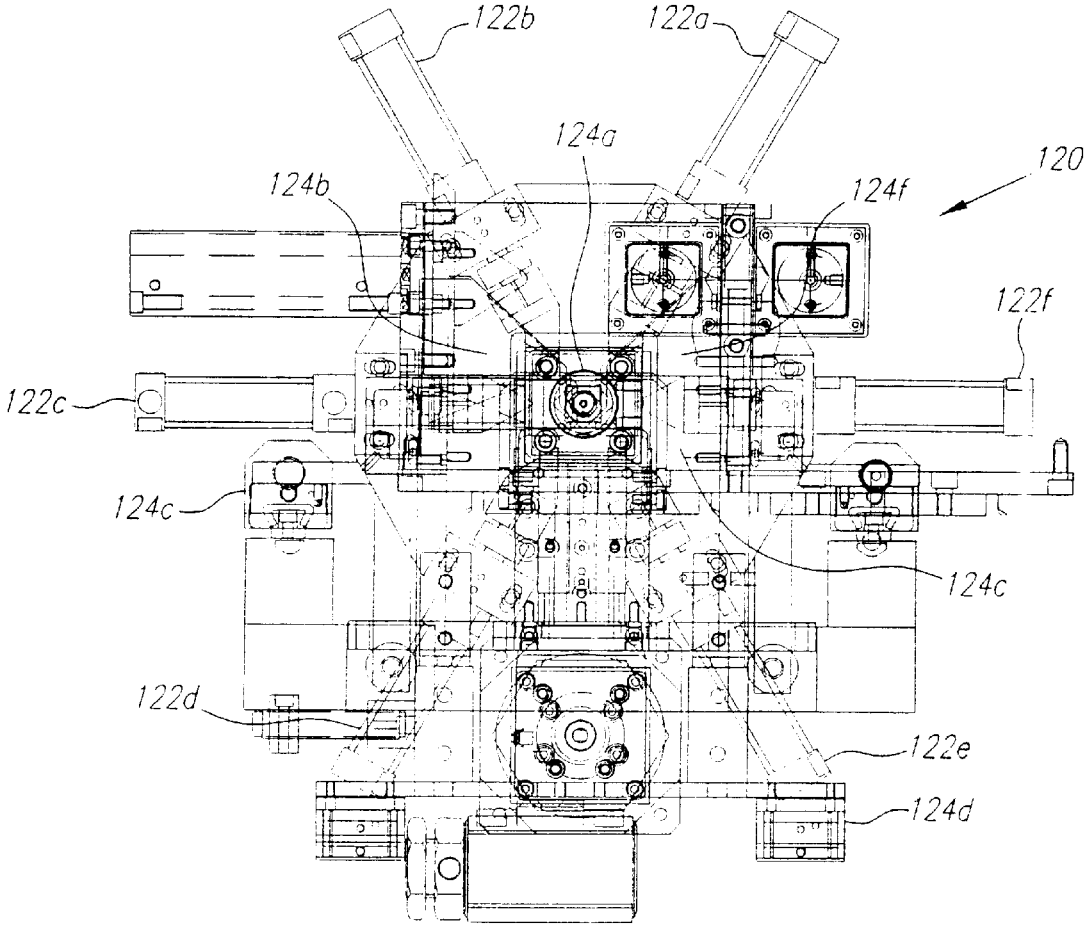

There is illustrated in FIG. 12 a front view of the jaw assembly of the grip mechanism of the apparatus of the present invention.

Figure 13:
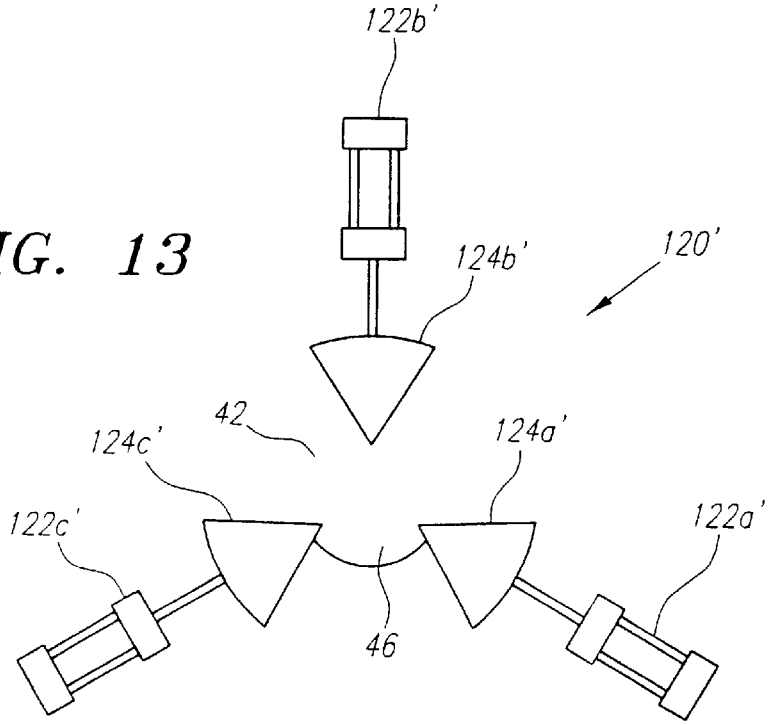

There is illustrated in FIG. 13 an isolated front view of an alternative embodiment of the jaw assembly of the apparatus of the present invention engaging a handgrip.

Figure 14:
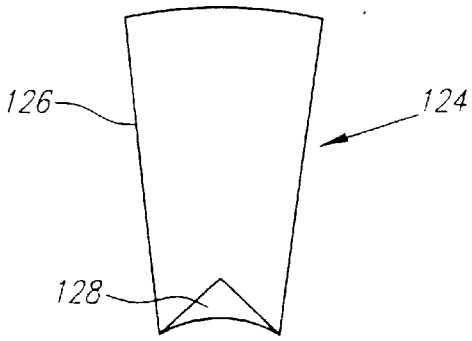

There is illustrated in FIG. 14 an isolated front view of a jaw of the apparatus of the present invention.

Figure 15:
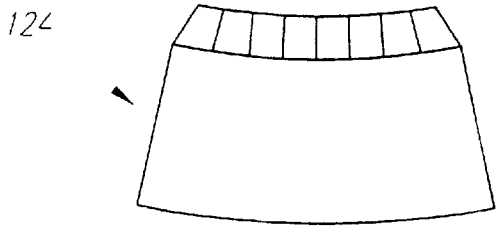

There is illustrated in FIG. 15 an isolated top plan view of a jaw of the apparatus of the present invention.

Figure 16:
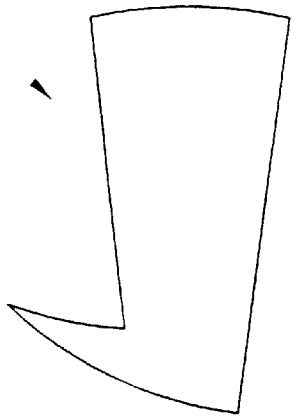

There is illustrated in FIG. 16 an isolated side view of a jaw of the apparatus of the present invention.

Figure 17:
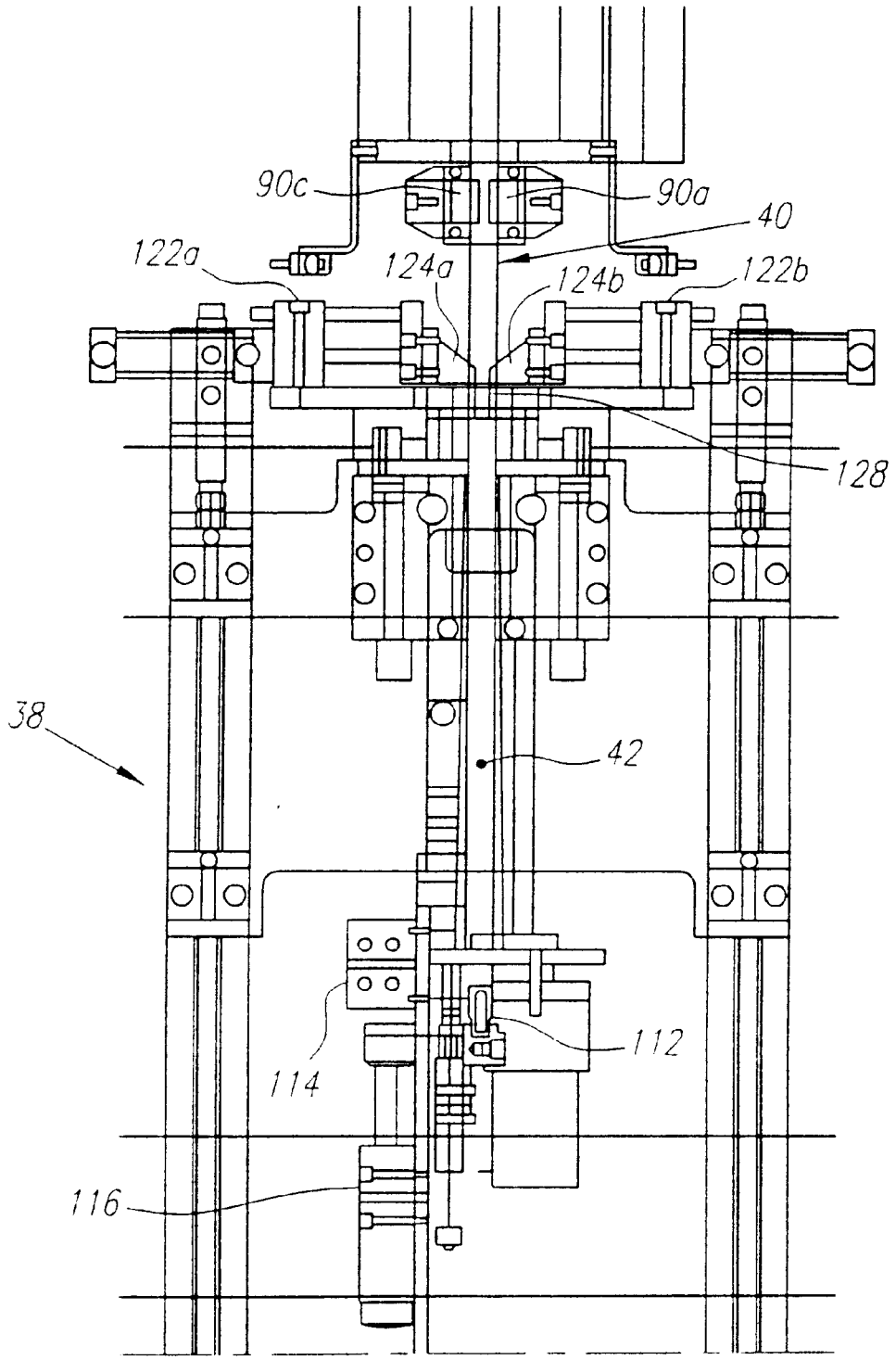

There is illustrated in FIG. 17 a top plan view of the grip mechanism with a handgrip being installed on a golf club shaft.

Figure 18:
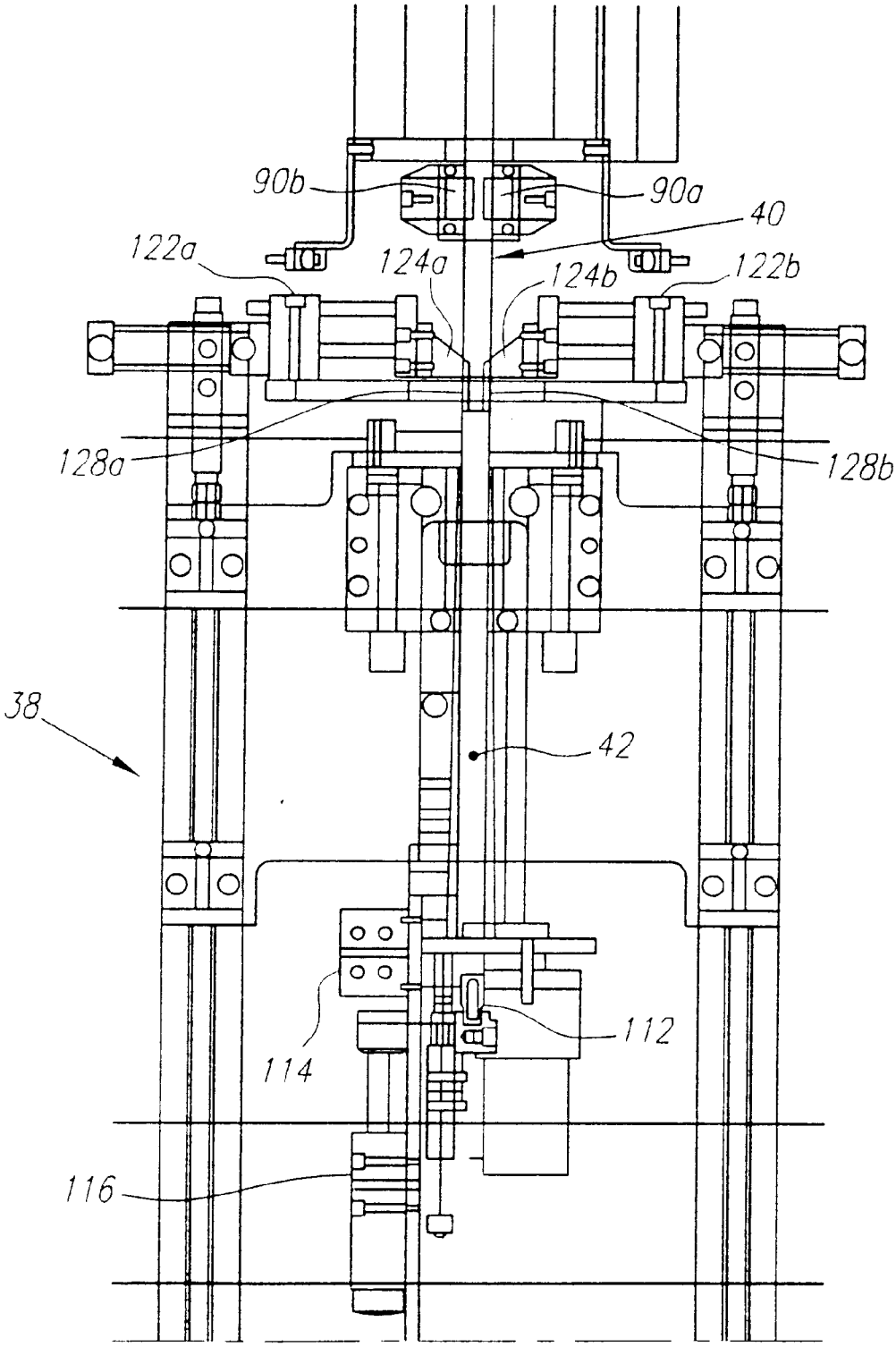

There is illustrated in FIG. 18 a top plan view of the grip mechanism immediately after a handgrip has been installed on a golf club shaft.

Figure 19:
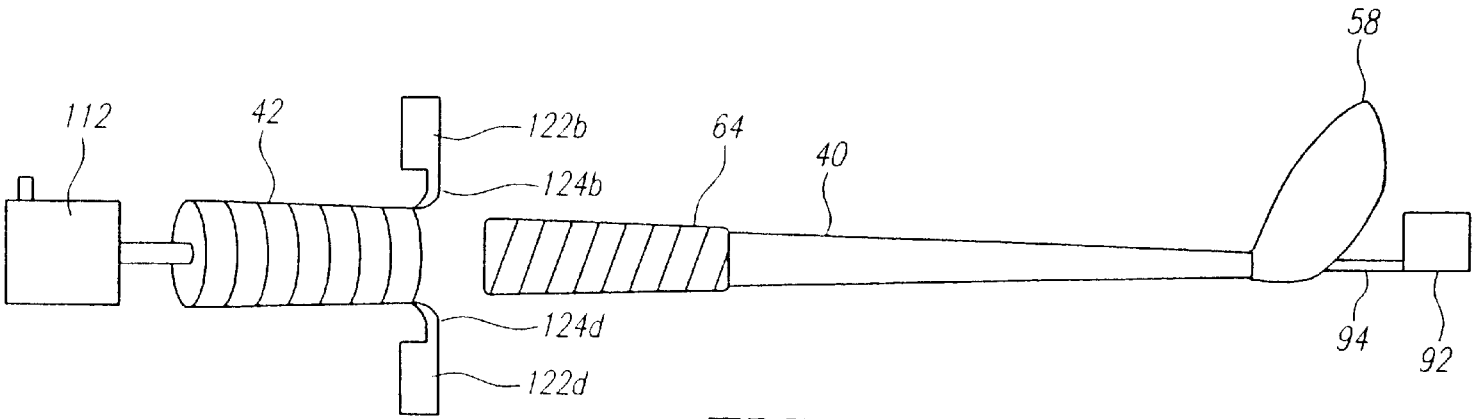

There is illustrated in FIG. 19 a schematic side view of a handgrip being installed on a golf club shaft at a first point in time.

Figure 20:
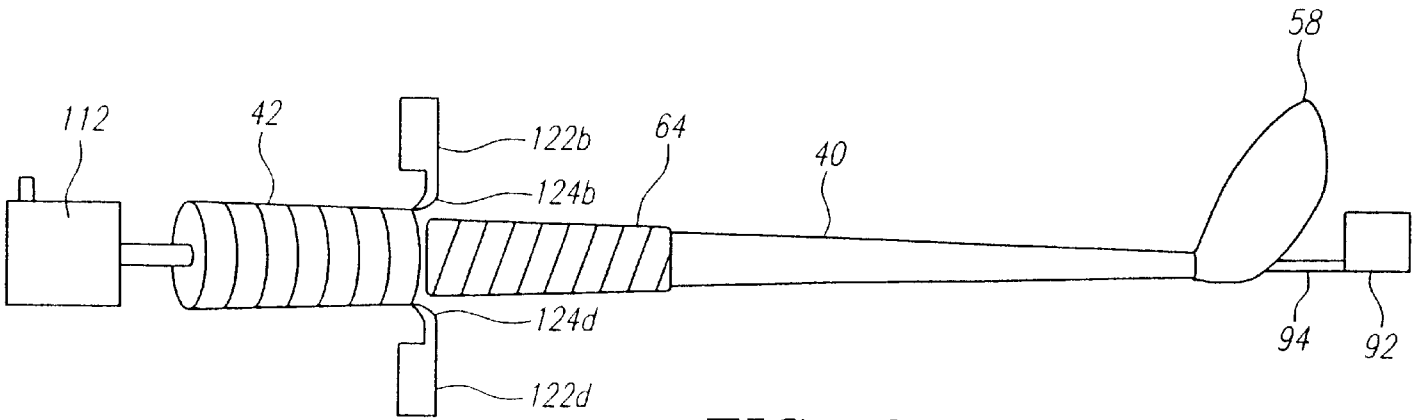

There is illustrated in FIG. 20 a schematic side view of a handgrip being installed on a golf club shaft at a second point in time.

Figure 21:
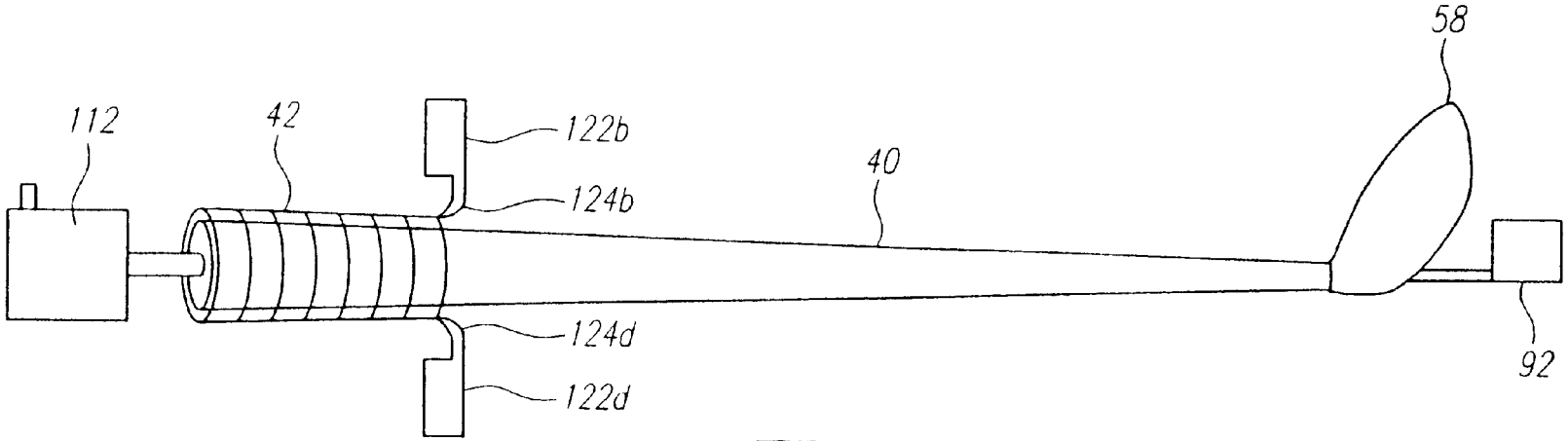

There is illustrated in FIG. 21 a schematic side view of a handgrip being installed on a golf club shaft at a third point in time.

Figure 22:
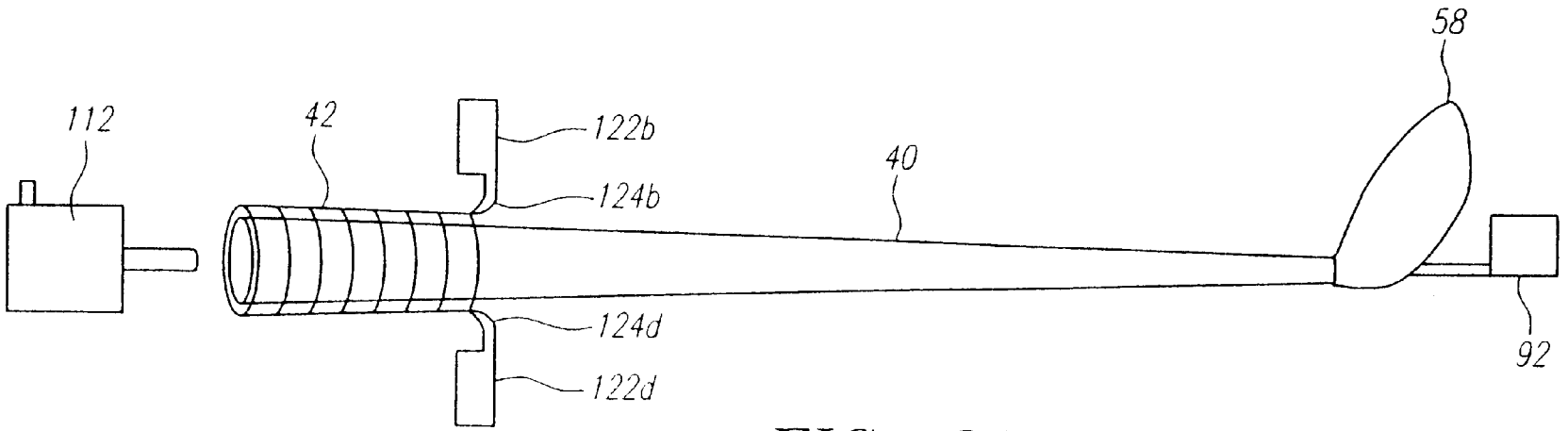

There is illustrated in FIG. 22 a schematic side view of a handgrip installed on a golf club shaft immediately after installation.

DETAILED DESCRIPTION OF THE INVENTION

Figure 1:
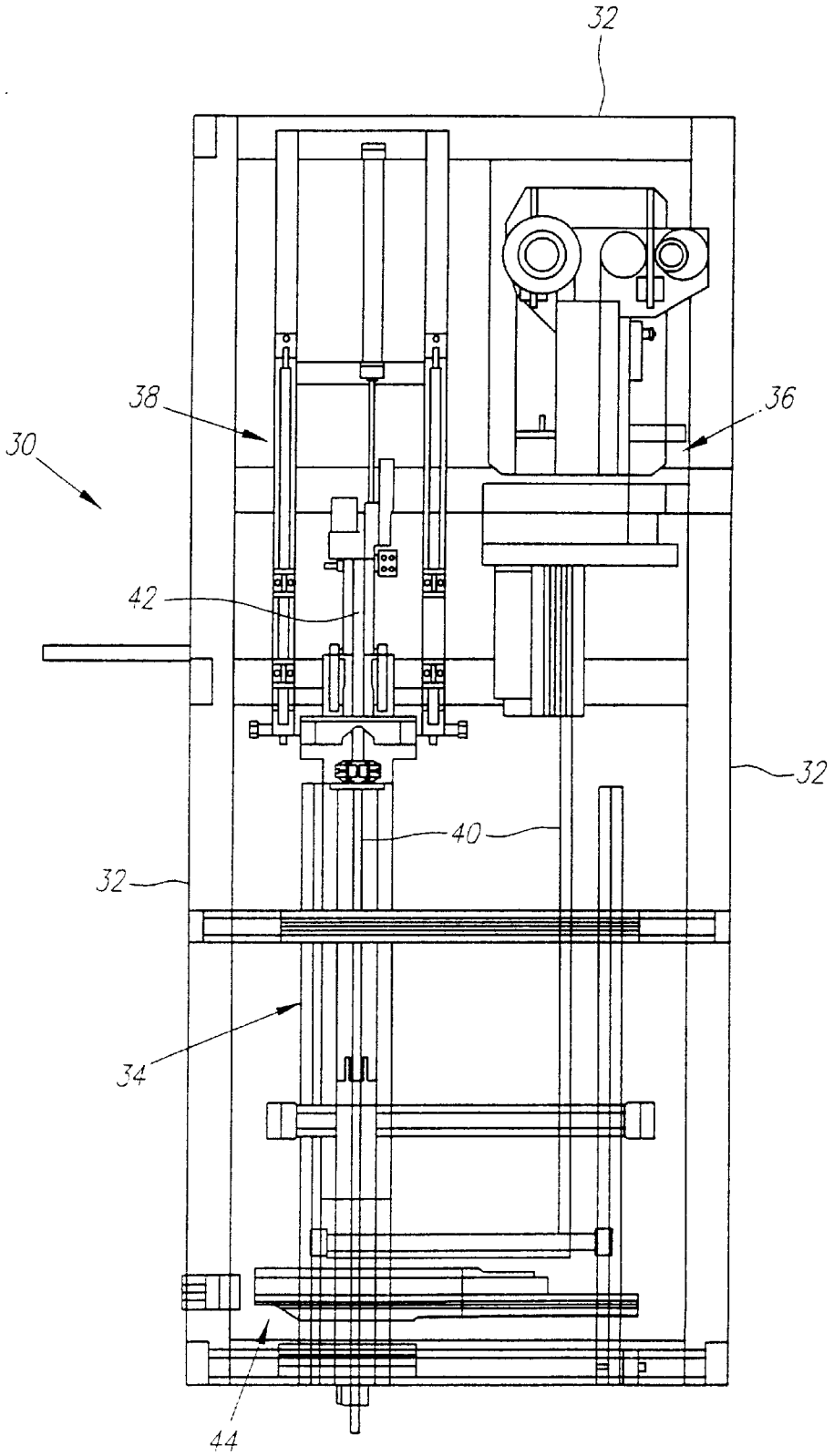

The apparatus and method of the present invention is directed at a installing a hand grip onto a golf club shaft while maintaining the handgrip and the butt end of the golf club shaft in a dry state. As shown in FIG. 1, the automatic grip installation apparatus of the present invention is generally designated 30. The apparatus 30 generally includes a frame 32, a shaft shuttle mechanism 34, a taping mechanism 36 and a grip mechanism 38. The shaft shuttle mechanism 34, the taping mechanism 36 and the grip mechanism 38 are all mounted to the frame 32 at specific locations relative to each other. The taping mechanism 36 and the grip mechanism 38 are adjacent each other at one end of the frame 32 while the shaft shuttle mechanism 34 is mounted at the other end of the frame 32. The shaft shuttle mechanism 34 will transport a shaft 40 from one position in-line with the taping mechanism 36 to another position in-line with the grip mechanism.

Shafts are fed to the apparatus 30 from a source through conventional means such as a conveyor or the like. The shaft 40 is placed on the shaft shuttle mechanism 34 and transported to the taping mechanism 36 for placement of tape on the shaft 40. The taped shaft 40 is then transported by the shaft shuttle mechanism to a position in-line with the grip mechanism for installation of a handgrip 42 thereon (without the need of a solvent) and orientation of the shaft 40 by a shaft orientation device 44.

Figure 2:
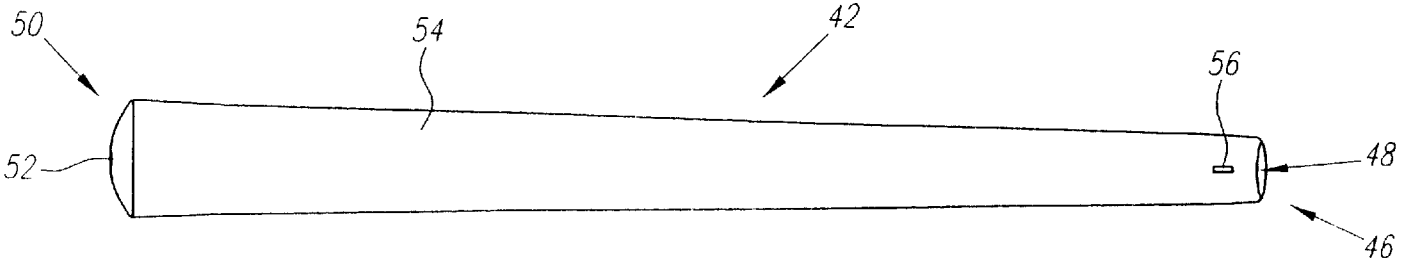

As shown in FIG. 2, a handgrip 42 generally has an open end 46 that allows access to a hollow interior 48. Opposite of the open end 46 is a closed end 50 that has an aperture 52 for additional access to the hollow interior 48 of the handgrip 42. On a body 54 of the handgrip 42 may be an alignment notch 56 for proper alignment of the handgrip 42 on the shaft 40. Although one type of handgrip 42 has been illustrated and described, those skilled in the pertinent art will recognize that most if not all types of handgrips may be utilized in conjunction with the present invention.

As shown in FIG. 3, the shaft 40 has a golf club head 58 attached thereon at a tip end 60 of the shaft 40. The tip end 60 is inserted through a bore 62 of the golf club head 58. The handgrip 42 is placed over a butt end 64 of the shaft 40. At the butt end 64 is an opening 66 to a hollow interior 68 of the shaft 40. Generally, the butt end 64 has a greater circumference than the tip end 60. The shaft 40 may be composed of a graphite material, a steel material or the like. The shaft may come in various lengths depending on the golf club. The golf club may be an iron, a wood, a driver or a putter. Although one type of shaft 40 has been illustrated and described, those skilled in the pertinent art will recognize that most if not all types of shafts may be utilized in conjunction with the present invention.

The application of a double-sided tape (adhesive on both sides) to the butt end 64 of a shaft 40 at the taping mechanism 36 is illustrated in FIGS. 4–8 (including 6A, 7A and 8A). A shaft 40 is positioned at the taping mechanism 36 by the shaft shuttle mechanism 34. The butt end 64 of the shaft 40 is positioned in relation to a length of tape 70 that is dispensed from a roll of tape 72 on a tape dispenser 74. The tape 70 is positioned by a tape shuttle 76 over the butt end 64 of a shaft 40. The tape shuttle 76 also assists in the removal of a backing 78 of the double-sided tape 70. The tape shuttle 76 moves from an extended position as shown in FIG. 4 to a retracted position as shown in FIG. 5.

The tape 70 is partitioned at a tape cutting assembly 80. The tape cutting assembly 80 generally includes a blade 82 and a drive mechanism 84. The drive mechanism 84 may be any conventional means such as a pneumatic cylinder or a servomotor. The blade 82 cuts the tape 70 to a predetermined length that has a portion extending further than the butt end 64 of the shaft 40. However, a tape roller 86 first presses the tape 70 against the butt end 64 of the shaft 40 for adhesion of one side of the tape 70 thereto. Then, the blade 82 cuts the tape to a predetermined length. The tape roller 86 may have a silicone rubber surface which does not adhere to the tape 70, thus allowing for the application of one side of the tape 70 to the butt end 64 of shaft 40 while maintaining the adhesiveness of the other side of the tape 70. The tape roller 86 may alternatively have a surface composed of a material with similar non-adhesive properties. During the application of the tape to the butt end 64 of the shaft 40, the shaft 40 is held in place by a plurality of shaft guides 90*a–d,* and the shaft is rotated by a plurality of shaft rollers 88*a–b.*

The application process is generally performed in following steps. First, as shown in FIGS. 6 and 6A, the middle 70*a* of the length of the tape 70 is applied to butt end 64 of the shaft 40. Next, the blade 82 cuts the tape to the predetermined length. Next, as shown in FIGS. 7 and 7A, a first side region 70*b* of the length of the tape 70 is applied by rotating the shaft 40 by the shaft rollers 88*a–b.* In a preferred embodiment, a shaft 40 is rotated approximately one-hundred ninety degrees. The shaft 40 is rotated in a reverse direction, and a second side region 70*c* of the tape 70 is applied to the butt end 64 of the shaft 40 which an end portion of the second side region 70*c* overwrapping an end portion of the first side region 70*b.* A wheel, not shown, larger than the tape roller 86 and located in proximity to a butt end of the tape roller 86, rolls the end of the tape 70 over the butt end 64 of the shaft 40 to provide a leading edge to assist in placing the handgrip 42 over the shaft 40. The tape roller 86 applies the tape 70 at a uniform pressure to conform the tape 70 to possible uneven surfaces of the shaft 40.

Once the butt end 64 of the shaft 40 is wrapped with the tape 70, the wrapped shaft 40 is transported to a position in-line with the grip mechanism 38. In a preferred embodiment, the transport of the shaft 40 is along a horizontal plane. However, the transport of the shaft 40 may take other non-horizontal paths. In addition to being in-line with the grip mechanism 38, the shaft 40 is also in-line with the shaft orientation device 44 which is opposite the grip mechanism 38.

As shown in FIG. 9, the shaft orientation device 44 generally includes a shaft gas injector 92 having a tip 94, and an optional head to shaft alignment member 96. The shaft orientation device 44 may be moved toward the shaft 40, or alternatively, the shaft 40 may be moved toward the shaft orientation device 44. In one embodiment, the club head 58 is placed on the shaft 40 subsequent to the installation of the grip 42 on the shaft 40. In an alternative embodiment, the club head 58 is placed on the shaft 40 prior to the shaft 40 being fed to the apparatus 30. Yet, in a further embodiment, the club head 58 is placed on the shaft 40 at the shaft orientation device 44. As mentioned previously, the shaft 40 is placed through a bore 62 of the club head 58.

With or without a club head 58, the shaft orientation device 44 orients the shaft 40 for placement of the handgrip 42 thereon. The tip 94 of the shaft gas injector 92 is inserted through the opening of the tip end 60 of the shaft 40. The tip 94, along with the alignment member 96, positions the shaft 40. If air is not flowed through the tip end 60 of the shaft 40, then the tip end 60 may be blocked to maintain the air pressure inside the handgrip 42 as further described below.

Referring now to the grip mechanism 38, handgrips 42 are fed to the apparatus 30 from a source through conventional means such as a conveyor or the like. Each handgrip 42 is placed on a receiving sleeve 100 of the grip mechanism 38 as shown in FIG. 10. The handgrip 42 is actually placed in a channel 101 of the receiving sleeve 100. The closed end 52 of the handgrip 42 is facing outward while the open end 46 is facing toward a grip mechanism housing 102. Once in the receiving sleeve 100, the handgrip 42 is oriented by a handgrip orientation device 104. The orientation of the handgrip 42 may be performed simultaneously with the wrapping of tape 70 on the butt end 64 of the shaft 40. The handgrip orientation device 104 generally includes a grip rotator 106 and a notch lever 108 with an engagement tip 110. The grip rotator 106 rotates the handgrip 42 within the channel 101 until the engagement tip 110 engages the notch 56 of the handgrip 42. Although the handgrip orientation device 104 as described may be applicable to many handgrips, those skilled in the art will recognize that other orientation devices such as laser alignment devices could be used for other handgrips that do not have a notch 56.

Once the handgrip 42 is oriented properly, a grip gas injector 112 having a tip 114 engages the handgrip 42 through the aperture 52 of the closed end 50 of the handgrip 42. The grip gas injector 112 is moved toward the handgrip 42 by a drive mechanism 116. The drive mechanism 116 may be a pneumatic cylinder, a servomotor, or the like. The grip gas injector 112, with the tip 114 inserted through the aperture 52, pushes the handgrip 42 into the grip mechanism housing 102 for the expansion process. Once in the grip mechanism housing 102, the handgrip 42 is ready for expansion. The grip mechanism housing 102 has a chamber 103 with a predetermined volume that limits the amount of expansion of the handgrip 42. The chamber 103 ensures that the handgrip is not over expanded which might result in damage to the handgrip.

As shown in FIG. 12, a jaw assembly 120 is located on the opposite side of the grip mechanism housing 102. The jaw assembly 120 generally includes a plurality of jaws 124*a–f* which have individual drive mechanisms 122*a–f*. The individual jaw drive mechanisms 122*a–f* may be pneumatic cylinders, servomotors, or the like. In FIG. 12, the jaw assembly 120 has six jaws 124*a–f* while in FIG. 13 an alternative jaw assembly 120' has three jaws 124*a'–c'*. As shown in FIG. 13, the jaws 124*a'–c'* engage the open end 46 of the handgrip 42 to expand the open end 46 for placement of the shaft 40 therein.

As shown in FIGS. 14–16, each jaw 124 has an elongated body 126 and an engagement member 128. The engagement member 128 enters the hollow interior 48 of the handgrip 42 through the open end 46 in order to exert an outward force on the interior of the handgrip 42 for expansion of the open end 46.

As shown in FIGS. 17 and 18, the grip mechanism 38, with a handgrip 42 therein, is moved by a drive mechanism 130, not shown, toward the shaft 40 which has previously been aligned by the shaft orientation device 44. The drive mechanism 130 may be a pneumatic cylinder, a servomotor, or the like. Alternatively, the shaft 40 may be moved by the shaft shuttle mechanism 34 toward the grip mechanism 38. Once the wrapped butt end 64 of the shaft 40 engages the open end 46 of the handgrip 42, the grip gas injector 112 flows a gaseous medium, preferably air, into the hollow interior 48 of the handgrip 42 to expand the hollow interior 48 from a first diameter to a second diameter. While the handgrip 42 is placed over the shaft 40, the jaws 124*a–f* engage the open end 46 of the handgrip 42 in an expanded state. The expansion of the open end 46 and the hollow interior 48 allows for the handgrip to be placed over the butt end 64 of the shaft 40 in a dry, solventless state. More specifically, there is no need for a solvent, an aqueous medium or lubricant in order to place the handgrip 42 onto the butt end of the shaft 40. Thus, the entire operation may be performed in a dry state which is beneficial for a safe and environmentally friendly workplace. The dry state operation is also provides a tremendous costs savings.

Once the handgrip 42 is in place on the shaft 40, the plurality of jaws 124*a–f* move forward from the open end 46 of the handgrip 42. This allows the open end 46 to fit tightly on the shaft 40.

FIGS. 19–22 schematically illustrate the installation process. As shown in FIG. 19, the wrapped butt end 64 (wrapped with tape 70) of the shaft 40 is moved toward the open end 46 of the handgrip 42. The plurality of jaws 124*a–f* expand the open end 46 of the handgrip 42. As shown in FIG. 20, the wrapped butt end 64 of the shaft 40 meets the open end 46 of the handgrip 42 and acts as a barrier to the outward flow of the gaseous medium from the hollow interior 48. The hollow interior 48 is receiving the gaseous medium from tip 114 of the grip gas injector 112 which is inserted through the aperture 52 of the closed end 50 of the handgrip 42. The gaseous medium may also be flowing through the hollow interior 68 of the shaft 42 from the tip 94 of the shaft gas injector 92 which is inserted through the tip end 60 of the shaft 42. The counter-flow of the gaseous medium from the shaft gas injector 92 also acts as a barrier to flow of the gaseous medium from the grip gas injector 112. The blockage of flow of the gaseous medium results in the expansion of the hollow interior 48 of the handgrip 42 from a first diameter to a second diameter. For example, the first diameter may be 1.3 cm while the second diameter is 3.0 cm. The second diameter must be large enough to accommodate the wrapped butt end 64 of the shaft 40 without substantial contact between the interior surface of the handgrip 42 and the tape 70. It is the expansion that allows for the installation process to occur in a dry state. Alternatively, instead of a counter-flow of gaseous medium, the tip end 60 of the shaft 40 may be blocked to prevent the outflow of the gaseous medium from the grip gas injector 112. The gaseous medium is preferably air, however, those skilled in the art will recognize that other gaseous mediums such as nitrogen, helium, and the like may be used as the gaseous medium for the present invention. Yet another alternative would have a grip mechanism housing 102 that evacuates air within it to create a vacuum to allow for the outward pressure and expansion of the hollow interior 48 of the handgrip 42.

As shown in FIG. 21, the wrapped butt end 64 of the shaft has engaged the interior of the closed end 50 of the handgrip 42 resulting in the cessation of the flow of the gaseous medium into the hollow interior 48 and thereby resulting in the cessation of the expansion of the hollow interior 48. Thus, the interior surface of the hollow interior 48 of the handgrip 42 contacts the tape 70 wrapped on the butt end 64 of the shaft 40. As shown in FIG. 22, the jaws 124*a–f* move forward from the open end 46 of the handgrip 42, and the gas injectors 112 and 92 disengage from contact with the newly gripped golf club shaft 40. The gripped shaft 40 is then discharged from the apparatus for further processing.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An apparatus for automatically applying a handgrip to a butt end of a golf club shaft, the apparatus comprising:

a frame;

a tape mechanism mounted to the frame;

a handgrip assembly mounted to the frame, the handgrip assembly having an air injector disposed on a handgrip receiving sleeve, a plurality of jaws movable from a closed position to an expanded position, and a drive mechanism;

a shaft movement mechanism capable of movement from a position on the frame in-line with the tape mechanism to a position on the frame in-line with the handgrip assembly.

2. The apparatus according to claim 1 further comprising a handgrip orientation device disposed on the handgrip assembly, the handgrip orientation device capable of orienting a handgrip to a predetermined position.

3. The apparatus according to claim 1 wherein the tape mechanism further comprises a tape dispenser, a tape cutter disposed in proximity to the tape dispenser, a tape roller rotatable about a fixed axis, and a shaft rotation roller disposed in relation to the tape roller.

4. The apparatus according to claim 1 wherein the shaft movement mechanism further comprises a plurality of shaft guides for retention of a shaft therein during application of a handgrip to the shaft.

5. The apparatus according to claim 1 further comprising a shaft orientation device mounted on the frame and in-line with the handgrip assembly, the shaft orientation device comprising a shaft aligner and a second air injector.

6. An apparatus for automatically applying a handgrip to a butt end of a golf club shaft while maintaining the handgrip and the butt end of the golf club shaft in a dry state, the apparatus comprising:

a frame;

means for automatically applying a double-sided tape to the golf club shaft, the tape application means mounted to the frame;

means for receiving and orienting a handgrip, the receiving and orienting means mounted on the frame;

means for expanding a handgrip for placement on the butt end of a golf club shaft while in a dry state; and means for moving a shaft from a position on the frame in-line with the tape means to a position on the frame in-line with the expanding means.

7. The apparatus according to claim 6 further comprising means for receiving a shaft on the apparatus.

8. The apparatus according to claim 6 means for orienting a shaft placed in the shaft moving means.

9. The apparatus according to claim 6 further comprising means for moving a handgrip over a shaft disposed on the shaft moving means.

10. The apparatus according to claim 6 further comprising means for flowing a gaseous medium through an opening in a tip end of a shaft or through a bore of a club head.

* * * * *